United States Patent [19]

Stern

[11] 3,932,156

[45] Jan. 13, 1976

[54] RECOVERY OF HEAVIER HYDROCARBONS FROM NATURAL GAS

[75] Inventor: Sidney S. Stern, New York, N.Y.

[73] Assignee: Hydrocarbon Research, Inc., Morristown, N.J.

[22] Filed: Mar. 22, 1974

[21] Appl. No.: 453,842

Related U.S. Application Data

[63] Continuation of Ser. No. 294,225, Oct. 2, 1972, abandoned.

[52] U.S. Cl. ..... 62/17; 62/20; 62/23; 62/39; 208/341

[51] Int. Cl.[2] ..... F25J 3/00

[58] Field of Search ..... 62/9, 17, 20, 23, 27, 28, 62/36, 38, 39; 208/341

[56] References Cited

UNITED STATES PATENTS

| | | | |
|---|---|---|---|
| 2,666,019 | 1/1954 | Winn | 62/39 |
| 2,973,834 | 3/1961 | Cicalese | 62/20 |
| 3,261,168 | 7/1966 | Ruhemann et al. | 62/38 |
| 3,358,461 | 12/1967 | Hendrix | 62/17 |

*Primary Examiner*—Norman Yudkoff
*Assistant Examiner*—Frank Sever

[57] ABSTRACT

A gas recovery system primarily to recover propane and heavier hydrocarbons from a natural gas stream whereby separation is accomplished at lower pressures and higher temperatures normally required.

1 Claim, 1 Drawing Figure

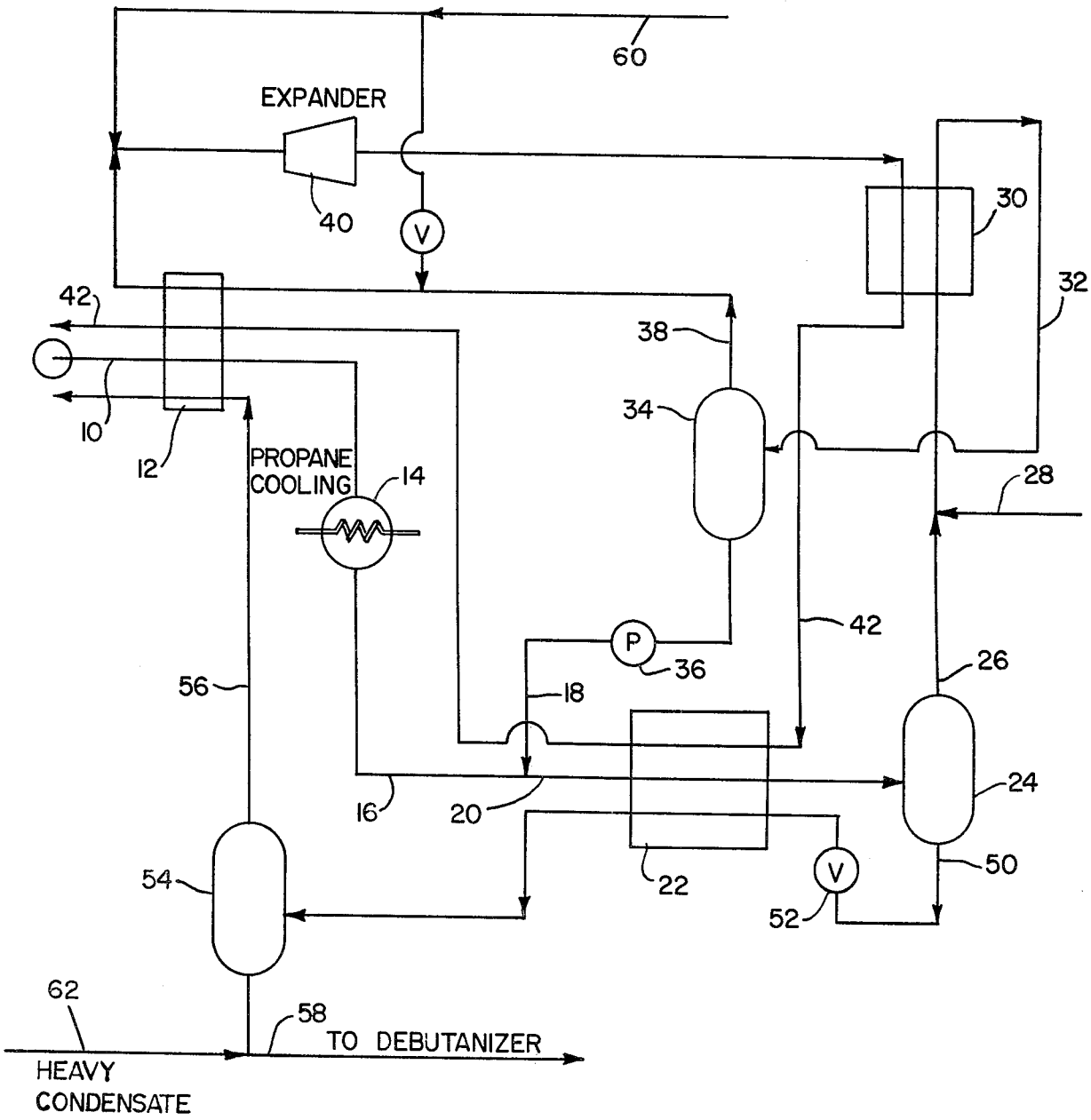
60
EXPANDER
40
V
30
32
42
38
34
10
12
PROPANE
COOLING
14
28
42
P
36
26
56
18
24
16
20
22
50
V
52
54
62
58
TO DEBUTANIZER
HEAVY
CONDENSATE

RECOVERY OF HEAVIER HYDROCARBONS FROM NATURAL GAS

This is a continuation of application Ser. No. 294,225, filed Oct. 2, 1972, now abandoned.

BACKGROUND OF THE INVENTION

The separation of heavier hydrocarbons from natural gas is known and an example of such development is in the U.S. Pat. No. 3,622,504, to Strum. In such case, certain cryogenic techniques are disclosed to minimize the loss of the heavier hydrocarbons. An earlier U.S. Pat. No. 2,973,834, to Cicalese, also involves the separation of heavier hydrocarbons from natural gas by condensation and distillation.

SUMMARY OF THE INVENTION

In accordance with my invention, I recover $C_3$ and heavier hydrocarbons from a natural gas stream by the use of a two drum flash system so that improved yields are possible operating at lower pressures and substantially higher temperatures. Together with the use of an expander, it is possible to operate at the lowest temperature level that will permit the drums to operate isothermally. A lean oil stream, recovered in the system is used to contact and recontact the gas.

DESCRIPTION OF THE DRAWING

The drawing is a schematic illustration of the principal elements of a low temperature gas separation process.

liquid removed at 18 is suitably pressurized at 36 to make up for pressure losses.

The overhead stream 38 from separator drum 34 is primarily methane. It is heated in exchanger 12 to about 35°F and combined with line 60 is then expanded in expander 40 from about 225 psig to about 25 psig. The temperature is thus reduced to about −91°F. The low pressure stream 42 is then warmed in exchanger 30 to about −42°F and further warmed in exchanger 22 to about −25°F. It discharges through exchange 12 at approximately ambient temperature and relatively low pressure. This stream is substantially free of hydrocarbons greater than $C_3$.

The liquid fraction removed from separator 24 at 50 is reduced in pressure through valve 52 to develop refrigeration for the heat exchanger 22. By flashing in chamber 54 at about −25°F and 95 psig, a substantial amount of methane and ethane are removed in line 56. The liquid removed at 58 then passes to the downstream equipment including a debutanizer. Being free of $C_1$ and $C_2$ fractions, it imposes a smaller load on the $C_4$ separation.

A supplemental high pressure stream 60 may also be used in the expander 40, such stream being a vent stream from the deethanizer downstream of the system.

In this operation, due to the low economic value for the methane and ethane, it is possible to recover substantially all of the higher hydrocarbons and still operate at temperatures as high as −25°F and pressures in the order of 235 to 250 psig.

One example of operation is as follows:

| Line No. | 10 | 28 | 56 | 58 | 60 | 62 | 42 |
|---|---|---|---|---|---|---|---|
| $C_1$ | 11690 | — | 641 | 235 | 384 | 149.2 | 11049 |
| $C_2$ | 3835 | — | 356 | 1398 | 1637 | 270.0 | 3448 |
| $C_3$ | 2555 | — | 83 | 1743 | 142 | 534.6 | 336 |
| i $C_4$ | 345 | — | 3 | 203 | — | 136.3 | 3 |
| n $C_4$ | 831 | 30 | 4 | 457 | — | 393.7 | 7 |
| i $C_5$ | 203 | 495 | 2 | 536 | — | 139.5 | 20 |
| $C_5$ | 223 | 550 | 1 | 592 | — | 161.2 | 18 |
| $C_6$ plus | 183 | 455 | 0.2 | 470 | — | 165.2 | 3 |
| $H_2S$ | 20 | — | 2 | 5 | 2 | 1.1 | 14 |
| $CO_2$ | 406 | — | 32 | 25 | 34 | 9.1 | 374 |
| Total | 20291 | 1530 | 1126 | 5664 | 2199 | 1959.9 | 15272 |
| PSIG | 240 | | 90 | | | | |

DESCRIPTION OF THE PREFERRED EMBODIMENT

The feed gas, an example of which is hereinafter disclosed, is a typical Kuwait natural gas stream which enters the system at 10. Preferably this gas is at about 240 psig, either by compressing or otherwise, and its temperature is approximately ambient in the order of 50°F and is water free. It is cooled by heat interchange in multiple section heat exchange 12 to a temperature of approximately 3.5°F. It is then further cooled in exchanger 14 by interchange with a refrigerant such as propane to about −16.5°F. The cooled gas at 16 is now blended with a liquid stream 18, hereinafter described, and the combined stream 20 is then further cooled in heat exchanger 22. A temperature in the order of −25°F and pressure of about 240 psig then prevails in flash separator 24.

The vapor stream removed at 26 is blended with a lean oil stream 28 and further cooled in exchanger 30 to form a combined liquid-vapor stream 32 which enters the second separator drum 34. This drum is also at approximately −25°F and approximately 235 psig. The It will be apparent that the lean oil stream 28 which enters flash chamber 34 through line 32 and passes by way of line 18 to act as an absorbent for part of the gases in line 16, separates out in drum 24 through line 50. This liquid then passes back to the debutanizer by means of line 58.

While I have shown and described a preferred form of embodiment of my invention, I am aware that modifications may be made thereto within the scope and spirit of the description herein and of the claims appended hereinafter.

I claim:

1. A process for recovering $C_3$ and higher hydrocarbons from a feed stream of natural gas largely composed of methane which comprises:

a. cooling said feed stream to a temperature of about −25°F at a pressure of about 240 psig;

b. adding a lean oil to said cooled stream and flashing said mixture to form a gasiform overhead and a condensate;

c. adding a lean oil to said gasiform overhead and cooling to about −25°F at a pressure of about 235 psig;

d. separating the mixture of step (c) to form the lean oil of step (b) and a gaseous overhead;

e. expanding said gaseous overhead of step (d) to about 25 psig;

f. recovering the refrigeration of said expanded overhead in the prior cooling steps;

g. flashing the condensate of step (b) to separate some methane and ethane;

h. and returning the balance of the condensate of step (b) to downstream equipment from which $C_3$ and higher hydrocarbons are recovered.

* * * * *